United States Patent [19]

Geissler

[11] Patent Number: 4,553,588

[45] Date of Patent: Nov. 19, 1985

[54] TUBE SUPPORT

[75] Inventor: Bernhard H. Geissler, Bartlesville, Okla.

[73] Assignee: Phillips Petroleum Company, Bartlesville, Okla.

[21] Appl. No.: 714,135

[22] Filed: Mar. 20, 1985

Related U.S. Application Data

[63] Continuation of Ser. No. 457,310, Jan. 11, 1983, abandoned.

[51] Int. Cl.[4] ..... F28F 1/32

[52] U.S. Cl. ..... 165/162; 165/172

[58] Field of Search ..... 165/162, 172; 248/68 CB

[56] References Cited

U.S. PATENT DOCUMENTS

| | | | |
|---|---|---|---|
| 3,240,267 | 3/1966 | Edberg | 165/162 |
| 3,708,142 | 1/1973 | Small | 165/162 |
| 3,765,629 | 10/1973 | Volker et al. | 248/68 CB |
| 3,850,235 | 11/1974 | Beckmann et al. | 165/162 |
| 4,127,165 | 11/1978 | Small | 165/162 |

FOREIGN PATENT DOCUMENTS

| | | | |
|---|---|---|---|
| 1235962 | 1/1964 | Fed. Rep. of Germany | 165/162 |
| 7906572 | 3/1981 | Netherlands | 165/162 |

*Primary Examiner*—Albert W. Davis, Jr.
*Assistant Examiner*—Peggy A. Neils
*Attorney, Agent, or Firm*—French and Doescher

[57] ABSTRACT

Low pressure drop tube support elements for use in shell and tube heat exchangers comprise a series of short tubular members assembled together in a chain fashion using wire or the like. Each assembly is easily mounted longitudinally in the tube bundle. The individual elements in the chain are interconnected so that when tension is applied to the chain, each element is wedged against the tubes.

13 Claims, 7 Drawing Figures

TUBE SUPPORT

This application is a continuation of application Ser. No. 457,301, filed Jan. 11, 1983, now abandoned.

BACKGROUND OF THE INVENTION

The invention relates to support apparatus suitable for use in a tube bundle. In another aspect, the invention relates to a tube bundle suitable for use in a shell and tube heat exchanger. In yet another aspect, the invention relates to the shell and tube heat exchanger. In further aspects, the invention relates to methods for tightening the tubes in in a tube bundle.

A major problem in the art of heat exchange is that of reliably supporting the tubes. The flow of fluid across the tubes in a tube bundle can induce vibrations of such magnitude that collision between the tubes themselves or tubes and tube supports can damage the tubes, or possibly even cause failure of one or more tubes. It would thus be very desirable to provide support structure for reliably supporting the tubes of the tube bundle.

One type of support structure known to the prior art involves the use of plate baffles. The baffles are provided with apertures therethrough with the tubes extending through the apertures. With plate baffles, however, it has proved very difficult to provide a sufficiently close fit between the outside of the tube and the inside of the aperture of the baffle in order to prevent the possibility of vibration induced damage between the tube and the baffle. Where clearances are precisely controlled, other problems can arise. Where insufficient fluid flows through the annulus between the baffle and the tube, localized overheating and vaporization of the fluid can occur with the deposition of solids when present. The solids can promote corrosion of the tubes and, in some events, lead to failure of the tubes. In other instances, the solids can build up in the annulus and expand to the point that fluid flow through the tube is impaired due to partial collapse of the tube. It would clearly thus be very desirable to provide a tube support means in which positive tube support and minimal risk of localized overheating, boil out and crevice corrosion are provided.

Another problem frequently encountered in the art is that of excessive pressure drop through the shell side of the tube bundle. Support structure extending through the bundle in a direction perpendicular to the direction of fluid flow can cause considerable pressure drop longitudinally through the bundle. As a general rule, pressure drop through the tube bundle increases with increasing volumes of tube support elements and an increasingly perpendicular orientation of the tube support elements to the fluid flow. The extent to which the tube support elements are streamlined is also an important factor. It would be clearly desirable to provide tube support apparatus which reliably supports the tube with minimal pressure drop of shell side fluid flowing through the tube bundle.

OBJECTS OF THE INVENTION

It is an object of this invention to provide support apparatus suitable for use in a tube bundle which will reliably support the tubes.

It is a further object of this invention to provide support apparatus suitable for supporting the tubes of a tube bundle in which minimal contact area between the tubes and the tube supports occurs.

It is a further object of this invention to support the tubes of a tube bundle with only a small increase in pressure drop.

Further objects of the invention include methods for satisfying the above objects.

SUMMARY OF THE INVENTION

In one aspect of the invention, an apparatus is provided comprising a first member having a longitudinal axis, a first end, a second end, and preferably a circular or polygonal cross section in a plane normal to its longitudinal axis; a first tether attached to a point at the first end of the first member; a second tether attached to a point at the second end of the first member; with the point at the second end of the first member being selected so that a line extending between the point at the first end of the first member and the point of the second end of the first member is not parallel to the longitudinal axis of the first member. This apparatus can be used in conjunction with the tube bundle to support the tubes by positioning the tethers in a direction more or less parallel to the axes of the tubes and pulling on the tethers so as to torque the first member into contact with adjacent parallel tubes. Where the first member has a tubular shape, tube support can be accomplished with low pressure drop. Where the first member has a short length as compared to its width, the contact area between the support element and the tubes will be sufficiently small to reduce the risk of crevice corrosion and the like.

In another aspect of the present invention, a tube bundle suitable for use in a shell and tube heat exchanger is provided which comprises a first tube sheet; a second tube sheet; a plurality of parallel tubes extending between the first tube sheet and the second tube sheet, said plurality of parallel tubes being arranged to form a first plurality of parallel tube rows and a second plurality of parallel tube rows; and a plurality of tube support elements extending between the tube sheets with each element being positioned between adjacent parallel tubes, where each tube support element preferably comprises a first member, a first tether, and a second tether as described above. Where a sufficient number of tube support elements are provided in the tube bundle, a sturdy, rigid bundle results which is reliable and suitable for deployment in the shell to form a shell and tube heat exchanger.

In another aspect of the present invention, a method is provided comprising providing a tube bundle with longitudinally extending support elements between the tubes, each of the longitudinal extending support elements comprising a series of short tubular members interconnected by tethers so that the short tubular members cock and press against the tubes when the tethers are longitudinally tensioned; and longitudinally tensioning the tethers sufficiently to cock the tubular members to wedge against the tubes. In this method, the bundle is tightened by the manipulation of tightening means located at one end of the tube bundle, which can be quite advantageous if it is desired to tighten the bundle while it is positioned in a heat exchanger shell.

In yet another aspect of the invention, a method is provided for constructing a tube bundle suitable for use in a shell and tube heat exchanger, said method comprising positioning a generally planar layer of parallel tubes in a suitable fixture so that said tubes are generally equally spaced apart; positioning a generally planar layer of tube support elements, each of which preferably comprises a series of short tubular members connected by tethers on top of the generally planar layer of parallel tubes, each tube support element extending generally parallel to and being supported by a pair of generally parallel adjacent tubes in the layer of tubes situated therebeneath and extending for the full length of said pair of parallel adjacent tubes; positioning a generally planar layer of parallel tubes on top of the generally planar layer of tube support elements with tubes in the generally parallel layer of tubes on top of the layer of tube support elements being supported by tube support elements situated therebeneath; repeating the above last two steps a desired number of times to form a bundle of tubes and tube support elements; attaching the ends of the tubes and the ends of the tube support elements to tube sheets; and tensioning the tube support elements to cock the short tubular members sufficiently to tighten the tube bundle. In this manner, there is provided a tube bundle which is reliably supported against vibrations which could lead to tube failure.

DETAILED DESCRIPTION OF THE INVENTION

Figure 1:
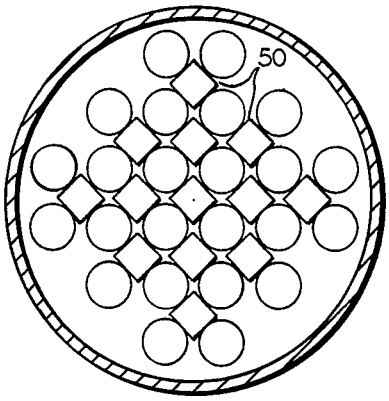
FIG. 1 is an end sectional representation of a shell and tube heat exchanger in which certain features of one embodiment of the invention are illustrated.
Figure 2:
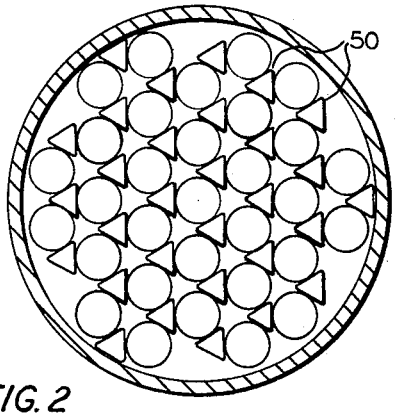
FIG. 2 is an end sectional representation of a shell and tube heat exchanger in which certain features of another embodiment of the invention are illustrated.
Figure 5:
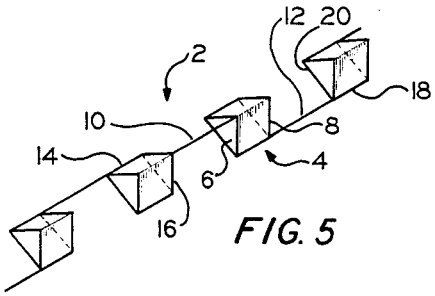
FIG. 5 is an isometric representation illustrating certain other features of the embodiments of the invention illustrated in FIG. 4.

With reference to FIG. 5, an apparatus 2 comprises a first member 4 having a first end 6 a second end 8 bordered by the dashed line, and a longitudinal axis extending from the end 6 to the end 8, with the member 2 usually being generally symetric with respect to the longitudinal axis. Preferably, the member 4 will have a circular or polygonal cross section in a plane normal to its longitudinal axis. In the embodiments of the invention shown in FIG. 5, for example, the first member has a triangular cross section, preferably an equilateral triangular cross section. In the embodiment of the invention shown in FIG. 1, for example, the first member has a generally rectangular, preferably square cross section. Other polygonal cross sections can be used if desired, but unnecessarily complicate the tube support scheme of the present invention. Preferably the first member 4 comprises a tubular member, since the hollowed out elements 4 will generally be cheaper, lighter and cause less pressure drop when deployed to support the tubes of the tube bundle than solid elements 4.

A first tether 10 is attached to a point at the first end 6 of the first member 4. A second tether 12 is attached to a point at the second end 8 of the first member 4. The point at the second end of the first member 4 is selected so that a line extending between the point at the first end of the first member to which tether 10 is attached and the point at the second end of the first member where the tether 12 is attached is not parallel to the longitudinal axis of the member 4. The series can be repeated as often as desired, and a plurality of first members 4 can be assembled together in a chain fashion using wire, tape, tubing or the like for tethers 10 and 12. The tethers 10 and 12 can be attached to the members 4 in any suitable manner, such as by welding. The materials from which the elements 4 and tethers 10 and 12 are constructed should be compatible with the materials from which the tube bundle is constructed under the conditions of service. Preferably, each tubular member has a wire or tape section connected to each end thereof adjacent the external periphery of the end in a manner such that the loci of connections of the two wire or tape sections to the tubular member do not lie in an imaginary straight line which is parallel to the longitudinal axis of the tubular member.

Figure 3:
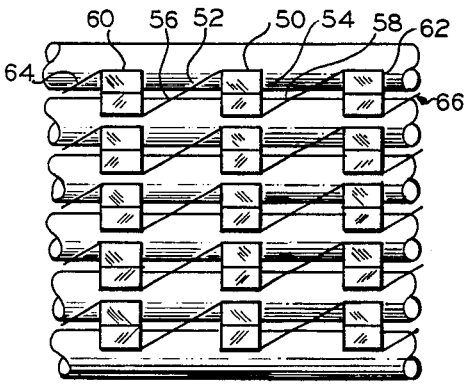
FIG. 3 is a side sectional fragment illustrating certain other features of the embodiment of the invention shown in FIG. 1.
Figure 4:
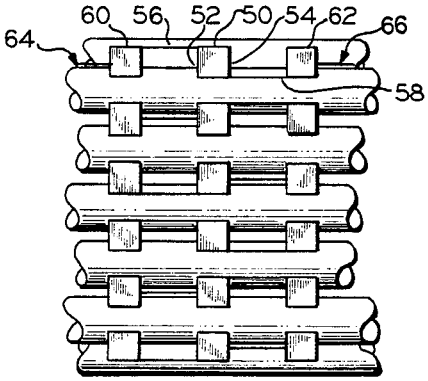
FIG. 4 is a side sectional fragment illustrating certain other features of the embodiment of the invention shown in FIG. 2.

In the embodiment of the invention shown in FIG. 4, each tubular member has a triangular cross section and a line drawn between the points of the tubular member to which the tethers are connected is skewed with respect to the longitudinal axis of the tubular member. In the embodiment of the invention shown in FIG. 3 each tubular member is provided with a generally square cross section and a line drawn between the points of connection of the tethers intersects with the longitudinal axis of the tubular member.

In one manner of use, (FIG. 5) a second tubular member 14 preferably identical to the first tubular member 4 is attached to the first tether 10 by its second end 16 and a third tubular member 18, preferably identical to the first tubular member 4 and the second tubular member 14 is attached to the second tether 12 by its first end 20. In some embodiments, the first tether 10 and the second tether 12 are each approximately parallel to the longitudinal axis of the tubular member 4. In other embodiments, such as that shown in FIG. 3, the first tether and the second tether each approximately intersect the line of the longitudinal axis of the tubular member. In still other embodiments, the first tether and the second tether can be skewed with respect to the longitudinal axis of the first tubular member.

Figure 6:
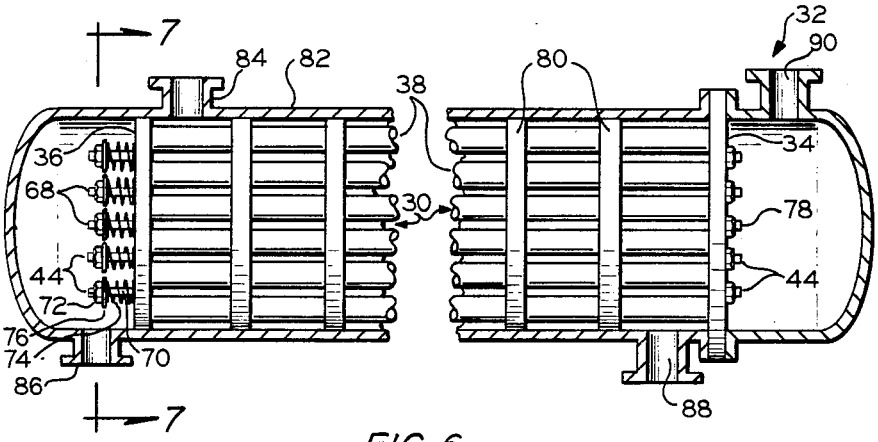
FIG. 6 is a side representation of a shell and tube heat exchanger embodying certain features of one embodiment of the present invention with the shell taken in cross section and tube bundle viewed in perspective.
Figure 7:
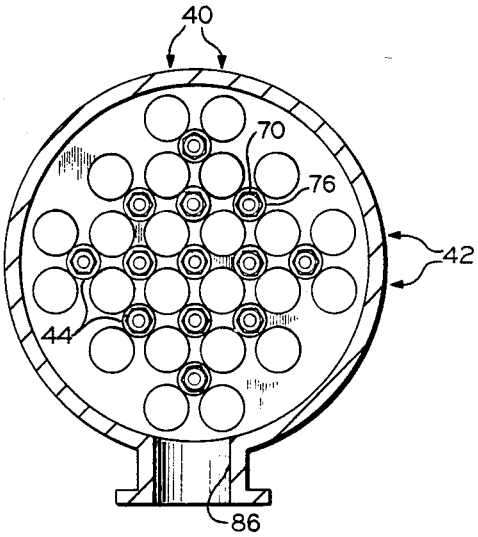
FIG. 7 is an end sectional view of the heat exchanger shown in FIG. 6 as viewed along the indicated lines.

With reference to FIG. 6, there is provided a tube bundle 30 suitable for use in a shell and tube heat exchanger 32. The tube bundle comprises a first tube sheet 34, a second tube sheet 36, and a plurality of parallel tubes 38 extending between the first tube sheet 34 and the second tube sheet 36. The tubes 38 are arranged to form a first plurality of parallel tube rows 40 as shown in FIG. 7 and a second plurality of parallel tube rows 42. A plurality of tube support elements extend between the tube sheets 34 and 36, with each element 44 being positioned between adjacent parallel tubes 38. With reference to FIGS. 1–4, each tube support element 44 comprises a first member 50, having a first end 52, a second end 54, and a longitudinal axis extending between the end 52 and the end 54. Geometrically, the members can be defined with respect to a longitudinal axis (the axis that is parallel to the tube axis when the members are arranged in a tube bundle). Each member in any given position is contacted tangentially by a plurality of lines parallel to this axis. The shape of the member is such that a rotation of the member around a rotational axis (which is not parallel to the longitudinal axis) through a finite angle causes at least two, preferably at least three of said lines to be spread further apart than before the rotation. This spreading of tangent lines characterizes either the getting into contact of the member with tubes or the slightly pressing apart of the tubes by the member. The rotation of the member is achieved by the pulling of the tethers. The members can be elastically deformable, and in this embodiment preferably are constructed so that the tubes slightly deform, compress or indent the members when the torque is applied to the members by the tethers. Preferably, each tubular member 50 is symmetric with respect to the longitudinal axis and has a circular or polygonal tubular cross section in a plane normal to its longitudinal axis. A first tether 56 is attached to a point at the first end of the first tubular member 50. A second tether 58 is attached to a point at the second end 54 of the first tubular member 50, with the point at the second end 54 of the first tubular member 50 being selected so that a line extending between the point at the first end 52 of the first tubular member 50 and the point at the second end 54 of the first tubular member 50 is not parallel to the longitudinal axis of the tubular member. A second tubular member 60 which is preferably identical to the first tubular member 50 is connected by its second end to the tether 52. A third tubular member 62 preferably identical to the first tubular member 50 and the second tubular member 60 is attached by a point on its first end to the second tether 58. A means 64 connects the first end of the second tubular member 60 to the second tube sheet 36. A means 66 connects the second end of the third tubular member to the first tube sheet 34. Perferably, the means 64 includes a means 68 (FIG. 6) for biasing the tubular members 50, 60 and 62 away from the first tube sheet 34. In the emodiment shown in FIGS. 6 and 7, the means 68 comprises a shaft 70 which extends through the second tube sheet 36 and is attached by any suitable means to tether 64. A nut 72 is attached to the shaft 70 on the side of the tube sheet 36 opposite the tubes. The nut 72 is tightened against the tube sheet 36 to bias the tubular members away from the first tube sheet 34. In one embodiment, a spring, such as a helical spring 74 is disposed around the shaft 70 between the nut 72 and the tube sheet 36 and a washer 76 is preferably positioned between the nut 72 and the spring 74 to aid in assembly. A set bellows, not shown, or other suitable sets of caps can be positioned over shaft 70 in covering relationship and attached to the tube sheet 36 to seal the shell side fluid from the tube side fluid. A similar set of bellows or caps can be secured to the first tube sheet 34 to cover the ends of shafts 78 extending therethrough.

In a preferred embodiment, a plurality of rings 80 embrace and define the outer tube limit of the tube bundle. The rings 80 preferably fit closely inside of a shell 82 which surrounds the tube bundle to prevent channeling of fluid between the shell and the tube bundle. The shell is associated with the first tube sheet 34 and the second tube sheet 36 so as to isolate the inside of the tubes from the outside of the tubes, thus forming the bundle into a tube side and a shell side. The shell 82 is provided with the first inlet nozzle 84 for the introduction of a first fluid through the shell side of the tube bundle and a second inlet nozzle 86 for the introduction of a second fluid through the tube side of the tube bundle. The shell is provided with a first outlet nozzle 88 for the withdrawal of the first fluid from the shell side of the tube bundle and a second outlet nozzle 90 for the withdrawal of the second fluid from the tube side of the tube bundle.

The method of the present invention can be practiced by providing a tube bundle with longitudinally extending support elements between the tubes, where each of the longitudinally extending support elements comprises a series of short tubular members interconnected by tethers.

The short tubular members are preferably characterized by a length and width which have a relationship to the spacing between the tubes so that they can cock and press against the tubes when the tethers are longitudinally tensioned. The tethers are sufficiently longitudinally tensioned to cock the tubular members to wedge them against the tubes. Generally speaking, the tubular members will have a length which is less than the center-to-center spacing between adjacent tube rows. Preferably, the length of the tubular members is greater than their width, to prevent rotation past the point of maximum cross sectional width. Where the tubular members are characterized by a circular or square cross section, and the tube bundle is laid out in square pitch, the maximum length of the side of the square or diameter of the circle is preferably somewhat less than $\sqrt{2}$ (D-2r) where D is the tube spacing center-to-center and 2r is the outside tube diameter. Generally, the actual length or diameter will be between about 75 and 99% of this maximum, usually between about 80 and about 95% of the maximum. Where the tube bundle is laid out on triangular pitch, the maximum length of the side of the triangle of the triangular cross section of the member is $$2D - \frac{2r}{\sqrt{3}}$$

and the maximum diameter of a circular support member is $$\frac{D}{\sqrt{3}} - r,$$

wherein D is the distance between next tube axis and r is the outside tube radius. Generally speaking, the support elements are adjustably attached to at least one of the tube sheets such as the tube sheet 36 in FIG. 6 so that sufficient tension can be placed on the support element to cock the short tubular members to support the tubes.

In yet another aspect of the present invention, there is provided a method for constructing the tube bundle suitable for use in a shell and tube heat exchanger. A generally planar layer or first row of parallel tubes is positioned in a suitable fixture so that the tubes are generally equally spaced apart. A generally planar layer of tube support elements, each of which comprises at least one member, preferably a series of short tubular members connected by tethers, is placed on top of the generally planar layer of parallel tubes, with each tube support element extending generally parallel to and being supported by a pair of generally parallel adjacent tubes in the layer of tubes situated therebeneath. The tube support elements will extend for the full length of the pair of parallel adjacent tubes which it contacts. Another layer of generally parallel tubes is placed on top of the generally planar layer of tube support elements with each tube in the generally parallel layer of tubes on top of the layer of the support elements being preferably supported by tube support elements situated there beneath. The layers of tubes and tube support elements are then alternated so that a bundle of tubes and tube support elements is formed. The ends of the tubes and the ends of the tube support elements are affixed to tube sheets and then the tube support elements are tensioned sufficiently to cock the members in an amount sufficient to tighten the tube bundle. Tightening of the tube bundle is facilitated where an outer ring or series of outer rings define the outer tube limit of the bundle. This arrangement is therefore preferred. The tethers which interconnect the tubular members can extend generally longitudinally through the tube bundle between the tube rows in a zig-zag fashion as shown in FIG. 3 for example, or in an alternating generally parallel fashion as shown in FIG. 4, or the like. Preferably the tethers are arranged in such a way that they do not touch the tubes (see FIGS. 3 and 4).

While there have been shown and described certain preferred embodiments of the present invention, it is not to be construed as so limited, except to the extent that such limitations are found in the claims.

That which is claimed:

1. A tube bundle suitable for use in a shell and tube heat exchanger, said tube bundle comprising:

(a) a first tube sheet;

(b) a second tube sheet;

(c) a plurality of parallel tubes extending between the first tube sheet and the second tube sheet arranged to form a first plurality of parallel tube rows and a second plurality of parallel tube rows; and (d) a plurality of tube support elements extending between the tube sheets with the tube support elements being positioned between adjacent parallel tubes, where each tube support element comprises;

(i) a first member having a first end and a second end and a shape which can be contacted tangentially by a plurality of lines parallel to the plurality of parallel tubes and an axis of rotation between the first end and the second end generally normal to the parallel tubes such that rotation of the first member around the axis of rotation causes at least two of said lines to spread further apart;

(ii) a first tether attached to the first end of the first member; said first tether extending toward the second tube sheet;

(iii) a second tether attached to the second end of the first member; said second tether extending toward the first tube sheet;

(iv) a means connecting the first tether to the second tube sheet; and (v) a means connecting the second tether to the first tube sheet; wherein tensioning of the means connecting the first tether to the second tube sheet and the means connecting the second tether to the first tube sheet causes rotation of the first member about the axis of rotation.

2. Apparatus as in claim 1 wherein the first member is tubular and has a longitudinal axis and a cross section in a plane normal to said longitudinal axis.

3. Apparatus as in claim 2 wherein each tubular member has a square cross section in a plane normal to the tubes.

4. Apparatus as in claim 2 wherein each tubular member has a circular cross-section in a plane normal to the tubes.

5. Apparatus as in claim 2 wherein each tubular member has a triangular cross section in a plane normal to the tubes.

6. Apparatus as in claim 2 wherein each tubular member has a length which is less than the center-to-center spacing between adjacent tube rows.

7. A method comprising (a) a providing a tube bundle having a first tube sheet, a second tube sheet, and a plurality of parallel tubes extending between the first tube sheet and the second tube sheet arranged to form a first plurality of parallel tube rows and a second plurality of parallel tube rows;

(b) positioning a plurality of tube support elements extending between the tube sheets with the tube support elements being positioned between adjacent parallel tubes, wherein each tube support element comprises a first member having a first end and a second end and a shape which can be contacted tangetially by a plurality of lines parallel to the plurality of parallel tubes and an axis of rotation between the first and the second end generally normal to the parallel tubes such that rotation of the first member around the axis of rotation causes at least two of said lines to spread further apart, a first tether attached to the first end of the first member, said first tether extending toward the second tube sheet; a second tether attached to the second end of the first member, said second tether extending toward the first tube sheet; a means connecting the first tether to the second tube sheet; and a means connecting the second tether to the first tube sheet; and (c) tensioning the means connecting the first tether to the second tube sheet and the means connecting the second tether to the first tube sheet to rotate the first member about the axis of rotation and thereby contact the tubes.

8. A method as in claim 6 further comprising biasing the first member away from the first tube sheet.

9. A method as in claim 6 wherein each tubular member has a triangular cross section in a plane normal to the tubes.

10. A method as in claim 6 wherein each tubular member has a circular cross section in a plane normal to the tubes.

11. A method as in claim 6 wherein each tubular member has a square cross section in a plane normal to the tubes.

12. A method as in claim 6 further comprising determining the outer tube limit of the tube bundle with a plurality of rings longitudinally spaced apart along the tube bundle.

13. A method as in claim 6 wherein the connecting means is tensioned sufficiently to cock the tube support elements sufficiently to tighten the tube bundle.

* * * * *